United States Patent [19]

Wang

[11] Patent Number: 4,928,204

[45] Date of Patent: May 22, 1990

[54] PORTABLE ELECTRICAL APPLIANCE

[75] Inventor: Jui-Shang Wang, Taipei, Taiwan

[73] Assignee: Duracraft Corporation, Sudbury, Mass.

[21] Appl. No.: 316,826

[22] Filed: Feb. 28, 1989

[51] Int. Cl.[5] ..... H02B 5/00

[52] U.S. Cl. ..... 361/331; 16/124; 220/94 R; 220/334; 220/345; 312/244; 361/380

[58] Field of Search ..... 16/DIG. 12, 110, 112, 16/124, 251; 174/66; 220/94 R, 334, 345; 219/364, 366, 370; 307/150; 312/244; 361/331, 334, 340, 346, 380, 384, 390, 391, 395, 399

[56] References Cited

U.S. PATENT DOCUMENTS

| | | | |
|---|---|---|---|
| 2,973,602 | 3/1961 | Nessel | 312/244 |
| 4,331,883 | 5/1982 | Vitaloni | 307/150 |
| 4,737,616 | 4/1988 | Wen-Ying | 219/364 |

*Primary Examiner*—Gregory D. Thompson

*Attorney, Agent, or Firm*—John E. Toupal; Harold G. Jarcho

[57] ABSTRACT

An electrical appliance including an electrically powered device; an electrical control system coupled to the electrically powered device; and a housing comprising top and side surface portions, retaining the electrically powered device and the electrical control system and defining a handle chamber having an entry opening formed in one of the surface portions and including a recessed portion covered by a section of the one surface portion that is partially bordered by one edge portion of the entry opening. Also included with the appliance is a handle cover retained by the housing, covering the entry opening, and mounted for movement into the handle chamber so as to provide manual access to an inner surface of the section; and a bias mechanism biasing the handle into a position covering the entry opening.

17 Claims, 2 Drawing Sheets

PORTABLE ELECTRICAL APPLIANCE

BACKGROUND OF THE INVENTION

This invention relates generally to a portable electrical appliance and, more particularly, to a portable electrical appliance with an improved carrying handle and electrical control panel.

Portable electrical appliances are used extensively in a wide variety of environmental conditioning applications. Such portable electrical appliances include, for example, heaters, air conditioners, fans, humidifiers, dehumidifiers, etc. Typically, portable electrical appliances are equipped with carrying handles to facilitate their movement from place to place and a manually accessable control panel for use in regulating operation of the appliance. The functional and aesthetic characteristics of such carrying handles and control panels contribute significantly to the level of personal satisfaction provided by the appliances.

The object of this invention, therefore, is to provide a portable electrical appliance having both an improved carrying handle and an improved electrical control panel.

SUMMARY OF THE INVENTION

The invention is an electrical appliance including an electrically powered device; an electrical control system coupled to the electrically powered device; and a housing comprising top and side surface portions, retaining the electrically powered device and the electrical control system and defining a handle chamber having an entry opening formed in one of the surface portions and including a recessed portion covered by a section of the one surface portion that is partially bordered by one edge portion of the entry opening. Also included with the appliance is a handle cover retained by the housing, covering the entry opening, and mounted for movement into the handle chamber so as to provide manual access to an inner surface of the section; and a bias mechanism biasing the handle into a position covering the entry opening. The handle cover enhances the appearance of the appliance and minimizes the cleaning requirements thereof.

In a featured embodiment of the invention the housing further defines a compartment retaining the electrical controls and having an access opening formed in the one surface portions; and the appliance includes a lid retained by the housing, covering the access opening, and mounted for movement out of the access opening in a direction substantially parallel to the one surface portion thereby permitting manual access to the electrical controls. The lid is movable in a rectilinear path parallel to the housing's outer surface and can be retained in either an open or closed position as desired.

According to one feature of the invention, the one surface portion is the top surface portion of the appliance. Location of the handle cover and lid in the top surface facilitates access to the carrying handle and electrical controls.

According to other features of the invention, the handle cover and lid have outer surfaces that conform to the top surface portion thereby enhancing both the appearance and safety of the appliance.

According to still other features of the invention, the entry opening is rectangular and has one side formed by the one edge portion; and the handle cover is mounted for pivotal movement along a line adjacent to another edge of the rectangular opening opposite to the one edge portion. This arrangement provides in an efficient manner the desired handle cover functions.

According to yet another feature of the invention, the housing comprises a shield plate partially defining the handle chamber, having one edge attached to an inner surface portion of the top surface portion directly adjacent to the another edge and coextensive therewith, and projecting downwardly from the top surface portion at an acute angle thereto and in a direction toward the one edge portion of the entry opening. The shield plate effectively separates the handle chamber from the electrical components in the housing.

According to a further feature of the invention, the handle cover comprises a projection that engages an underside of the section of the top surface. Engagement of the projection and the section surface establishes for the handle cover a closed position flush with the top surface.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 3:
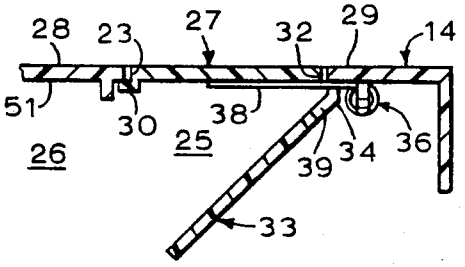
FIG. 3 is a cross sectional view taken along lines 3—3 of FIG. 1.
Figure 4:
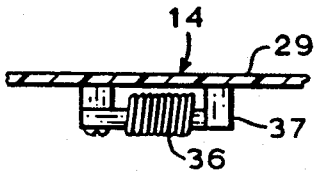
FIG. 4 is a cross sectional view taken along lines 4—4 of FIG. 1.
Figure 1:
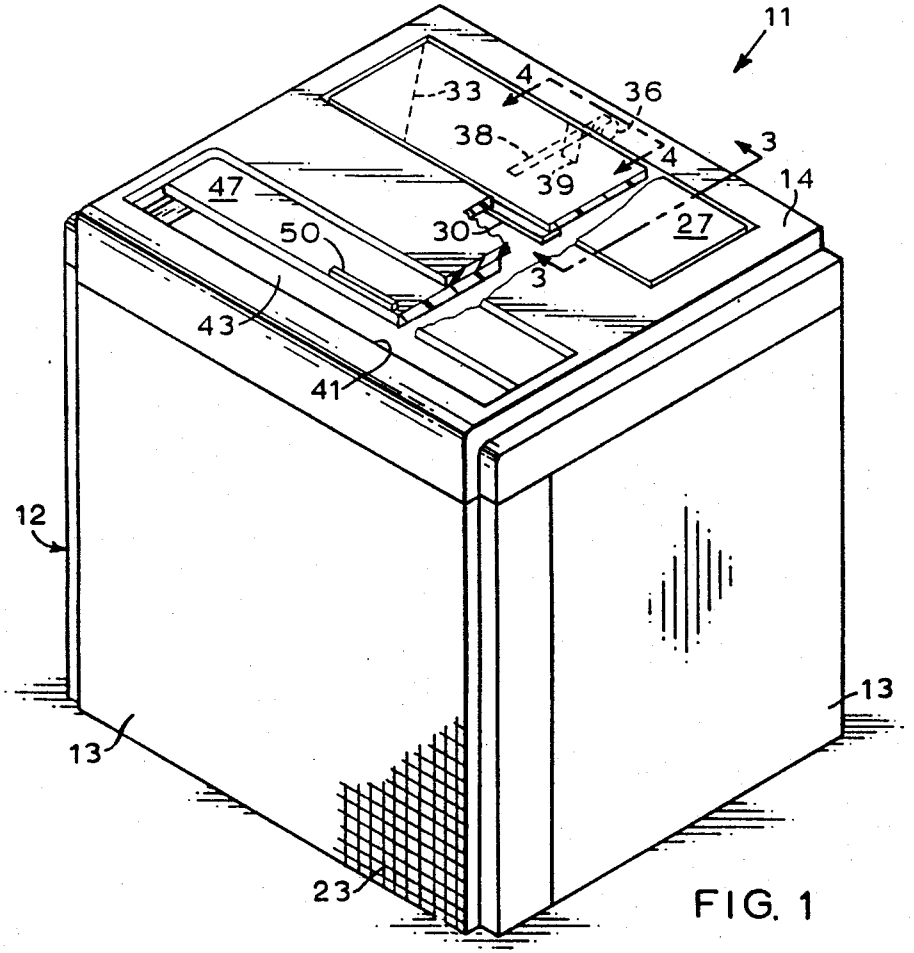
FIG. 1 is a perspective view, partially in cross section of a portable electrical appliance according to the invention.
Figure 2:
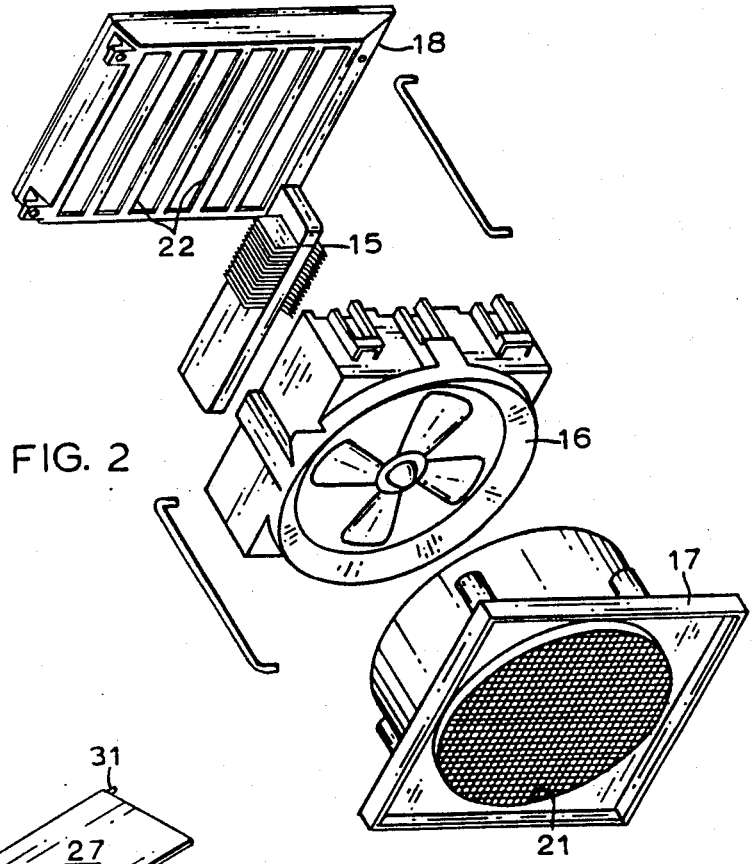
FIG. 2 is an exploded view of internal electrical components of the appliance shown in FIG. 1.
Figure 5:
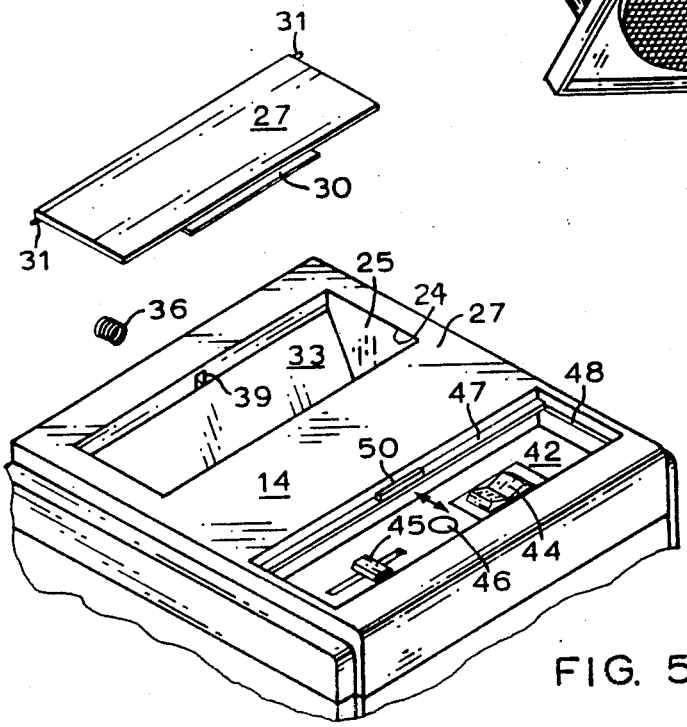
FIG. 5 is a partially exploded perspective view of the appliance shown in FIG. 1.

A portable electric appliance 11 includes an external housing 12 having side surface portions formed by sidewalls 13 and a top surface portion formed by a horizontal top wall 14. Retained within the housing 12 are an electrically powered heating coil 15 and an electrically powered fan 16 shown in FIG. 2. The housing 12 also retains a pair of end plates 17, 18 that straddle the heating coil 15 and the fan 16 and provide, respectively, an air inlet opening 21 and air distribution slats 22 aligned with an air outlet of the appliance 11.

Formed in the top wall 14 is a rectangular access opening 24 that provides access to a handle chamber 25 within the housing 12. The handle chamber 25 includes a recessed chamber portion 26 covered by a section 28 of the top wall 14 and bordered by one edge 23 of the entry opening 24. Completely covering the entry opening 24 in a closed position is a rectangular, horizontally disposed handle cover 27 extending parallel to the section 28 and a planar outer surface that conforms to the planar outer surface 29 of the top wall 14. Pins 31 extending from opposite ends of the handle cover 27 are pivotally retained by the housing 12 and permit pivotal movement of the cover 27 into the handle chamber 25 on a pivot line adjacent to another edge 32 of the entry opening 24 opposite to the edge 23 thereof. A lip 30 projecting from the handle cover 27 engages an inner surface portion of the top wall 14 adjacent to the edge 23 of the opening 24.

A shield plate 33 has an inner end 34 attached to an inner surface of the top wall 14 directly adjacent to the edge 32 of the entry opening 24. The shield plate projects downwardly from the top wall 14 at an acute angle thereto and in a direction toward the edge 23 of the entry opening 24 so as to partially define the handle chamber 25 and separate the handle chamber from the electrical components 15, 16. Biasing the handle cover 27 in a closed position covering the entry opening 24 is a coil spring 36 mounted in a spring holder 37 attached to the inner surface of the top wall 14. An elongated end 38 of the coil spring 36 extends through a central aperture 39 in the shield plate 33 and is centrally attached to an under surface of the handle cover 27.

Also formed in the top wall 14 is a rectangular access opening 41 that provides access to a control panel 42 mounted in a compartment 43 defined by the housing 12. Retained by the control panel 42 is an electrical control switch 44, a thermostatic control lever 45 and an indicator lamp 46 all electrically coupled to the electrical heating coil 15 and fan 16. A rectangular lid 47 completely covers the access opening 41 in a closed position and has a planar top surface that conforms to the planar outer surface of the top wall 14. Formed on an inner surface of the housing 12 are shoulders 48 that support opposite edges of the lid 47 and guide rectilinear sliding movement thereof directly under the section 27 of the top wall 14 so as to provide access to the compartment 43.

One desiring to transport the electrical appliance 11 from one location to another manually pushes the handle cover 27 to produce pivotal movement thereof into the chamber 25 and then grips an inner handle surface 51 of the section 28 of the top wall 14. Once desired movement of the appliance 11 has been accomplished and a mover's fingers withdrawn from the handle chamber 25, the spring member 36 automatically pivots the handle cover 27 back into its closed position established by the engagement between the projecting lip 30 and the underside of the section 28. Thus, the entry opening 24 is completely covered to provide the housing 12 with an aesthetically pleasing appearance and prevent entry of undesirable materials into handle chamber 25.

When access to the electrical switch 44 and lever 45 is desired, one merely grips a perpendicular projection 50 and slides the lid 47 into an open position under the section 28 of the top wall 14 so as to provide access to the compartment 43. After an electrical control function has been completed, the lid 47 can be returned to its closed position completely covering the access opening 41 and thereby preventing the entry of dirt and the like into the compartment 43. Because of its rectilinear movement, use of the lid 47 is not obstructed in any way by objects in close proximity to the appliance 11.

Obviously, many modifications and variations of the present invention are possible in light of the above teachings. For example, although described in conjunction with a heater, the inventions herein can be used with other portable appliances. It is to be understood, therefore, that the invention can be practiced otherwise than as specifically described.

What is claimed is:

1. An electrical appliance comprising:

an electrically powered device;

electrical control means coupled to said electrically powered device;

housing means comprising top and side surface portions, said housing means mechanically coupled to said electrically powered device and said electrical control means and defining a handle chamber having an entry opening formed in one of said surface portions, said handle chamber including a recessed portion covered by a section of said one said surface portion, and said section being partially bordered by one edge portion of said entry opening; and said housing means further defining a compartment retaining said electrical control means and having an access opening formed in one of said surface portions;

a lid retained by said housing means and covering said access opening, said lid mounted for movement out of said access opening thereby permitting manual access to said electrical control means;

a handle cover retained by said housing means and covering said entry opening, said handle cover mounted for movement into said handle chamber so as to provide manual access to an inner surface of said section; and bias means biasing said handle cover into a position covering said entry opening.

2. An electrical appliance according to claim 1 wherein said one said surface portion is said top surface portion.

3. An electrical appliance according to claim 2 wherein said handle cover has an outer surface conforming substantially to said top surface portion.

4. An electrical appliance according to claim 3 wherein said top surface portion and said outer surface are substantially planar.

5. An electrical appliance according to claim 4 wherein said bias means comprises a spring coupled between said top surface portion and said handle cover.

6. An electrical appliance according to claim 5 wherein said entry opening is a substantially rectangular opening having one side formed by said one edge portion; and said handle cover is mounted for pivotal movement along another edge of said rectangular opening opposite to said one edge portion.

7. An electrical appliance according to claim 6 wherein said housing means comprises a shield plate partially defining said handle chamber, said shield plate having one edge attached to an inner surface portion of said top surface portion directly adjacent to said another edge and coextensive therewith, and said shield plate projecting downwardly from said top surface portion at an acute angle thereto and in a direction toward said one edge portion of said entry opening.

8. An electrical appliance according to claim 7 wherein said lid is mounted for substantially rectilinear sliding movement on said housing means.

9. An electrical appliance according to claim 8 wherein said lid comprises a projection extending substantially normal thereto.

10. An electrical appliance according to claim 1 wherein said electrically powered device and said electrical control means are enclosed by said housing means.

11. An electrical appliance comprising:

an electrically powered means;

electrical control means coupled to said electrically powered means;

housing means comprising a horizontally disposed top surface portion and side surface portions extending therefrom, said housing means retaining said electrically powered means and said electrical control means and partially defining a handle chamber having an entry opening formed in said horizontal top surface portion, said handle chamber including a recessed portion covered by a section of said top surface portion, and said selection being partially bordered by one edge portion of said entry opening;

a horizontally disposed handle cover retained by said housing means, covering said entry opening and extending substantially parallel to said section of said top surface; said handle cover mounted for movement into said handle chamber so as to provide manual access to an inner surface of said section;

bias means biasing said handle cover into a position covering said entry opening; and shield plate means positioned within said housing means, partially defining said handle chamber and isolating said electrically powered means from said handle chamber.

12. An electrical appliance according to claim 11 wherein said shield plate means comprises a shield plate having one edge attached to an inner surface portion of said top surface portion directly adjacent to said another edge and coextensive therewith, and said shield plate projecting downwardly from said top surface portion at an acute angle thereto and in a direction toward said one edge portion of said entry opening.

13. An electrical appliance according to claim 12 wherein said handle cover comprises a projection that engages an inner surface of said section.

14. An electrical appliance according to claim 11 wherein said handle cover comprises an outer surface conforming substantially to said top surface portion.

15. An electrical appliance according to claim 14 wherein said top surface portion and said outer surface are substantially planar.

16. An electrical appliance according to claim 15 wherein said bias means comprises a spring coupled between said top surface portion and said handle cover.

17. An electrical appliance according to claim 16 wherein said entry opening is a substantially rectangular opening having one side formed by said one edge portion; and said handle cover is mounted for pivotal movement along another edge of said rectangular opening opposite to said one edge portion.

* * * * *

UNITED STATES PATENT AND TRADEMARK OFFICE

CERTIFICATE OF CORRECTION

PATENT NO. : 4,928,204

DATED : May 22, 1990

INVENTOR(S) : Jui-Shang Wang

It is certified that error appears in the above-indentified patent and that said Letters Patent is hereby corrected as shown below:

Column 5, line 4, cancel "selection" and substitute therefor --section--.

Signed and Sealed this

Twenty-sixth Day of October, 1993

*Attest:*

*Attesting Officer*

Bruce Lehman

BRUCE LEHMAN

*Commissioner of Patents and Trademarks*